US010692677B2

(12) United States Patent
Ji et al.

(10) Patent No.: US 10,692,677 B2
(45) Date of Patent: Jun. 23, 2020

(54) PERMANENT MAGNET OPERATING MECHANISM FOR USE IN AUTOMATIC TRANSFER SWITCH

(71) Applicant: Cummins Power Generation IP Inc., Minneapolis, MN (US)

(72) Inventors: Xuefeng Ji, Shanghai (CN); Tongxian Hu, Shanghai (CN); Dongyan Chu, Shanghai (CN)

(73) Assignee: Cummins Power Generation IP Inc., Minneapolis, MN (US)

( * ) Notice: Subject to any disclaimer, the term of this patent is extended or adjusted under 35 U.S.C. 154(b) by 72 days.

(21) Appl. No.: 15/739,623

(22) PCT Filed: Jun. 26, 2015

(86) PCT No.: PCT/CN2015/082435
§ 371 (c)(1),
(2) Date: Dec. 22, 2017

(87) PCT Pub. No.: WO2016/206067
PCT Pub. Date: Dec. 29, 2016

(65) Prior Publication Data

US 2018/0190460 A1 Jul. 5, 2018

(51) Int. Cl.
*H01H 3/00* (2006.01)
*H01H 50/18* (2006.01)
(Continued)

(52) U.S. Cl.
CPC ..... *H01H 50/18* (2013.01); *H01H 3/28* (2013.01); *H01H 47/22* (2013.01); *H01H 50/60* (2013.01); *H01H 2300/018* (2013.01)

(58) Field of Classification Search
CPC ..... H01H 50/18; H01H 50/60; H01H 47/22
(Continued)

(56) References Cited

U.S. PATENT DOCUMENTS 3,936,782 A * 2/1976 Moakler ..... H01H 3/28 335/161
4,021,678 A * 5/1977 Moakler ..... H01H 71/002 307/64
(Continued)

FOREIGN PATENT DOCUMENTS

CN 201112159 9/2008
CN 201262901 6/2009
(Continued)

OTHER PUBLICATIONS

Translation of International Search Report for International Application No. PCT/CN2015/082435, dated Apr. 1, 2016, 2 pages.

*Primary Examiner* — Shawki S Ismail
*Assistant Examiner* — Lisa N Homza
(74) *Attorney, Agent, or Firm* — Foley & Lardner LLP

(57) ABSTRACT

An automatic transfer switch system includes a contact subsystem having a plurality of movable contact members, including at least one first movable contact member and at least one second movable contact member at first and second locations, respectively, and at least one fixed contact member. The switch system further includes a permanent magnet operating mechanism that controls opening and closing of the movable contact members relative to the fixed contact member, generates a holding force to maintain a state of the at least one first movable contact member at the first location and a state of the at least one second movable contact member at the second location, and connects to the subsystem via a linkage, and a solenoid permitting movement of the at least one first movable contact member and the at least one second movable contact member at the first and second locations, respectively.

19 Claims, 6 Drawing Sheets

(51) Int. Cl.
*H01H 3/28* (2006.01)
*H01H 47/22* (2006.01)
*H01H 50/60* (2006.01)

(58) Field of Classification Search
USPC ..... 335/185
See application file for complete search history.

(56) References Cited

U.S. PATENT DOCUMENTS 4,423,336 A * 12/1983 Iverson ..... H01H 3/26 307/64
4,590,387 A 5/1986 Yoshida et al.
4,804,933 A * 2/1989 Becker ..... H01H 3/52 218/154
5,070,252 A * 12/1991 Castenschiold ..... H01H 71/002 307/113
6,815,624 B2 11/2004 Schultz
7,898,372 B2 * 3/2011 Melchionne, Jr. ..... H01H 3/28 200/1 R
8,138,861 B2 * 3/2012 Krieger ..... H01H 1/50 335/168
8,471,659 B1 * 6/2013 Flegel ..... H01H 9/26 307/126
2002/0057146 A1 * 5/2002 McMillan ..... H01H 89/06 335/35
2002/0130023 A1 * 9/2002 Milman ..... H01H 9/0066 200/293
2010/0038966 A1 * 2/2010 Espeut, Jr. ..... H01H 9/26 307/68
2014/0232491 A1 * 8/2014 Moroz ..... H01H 9/0072 335/128
2014/0240064 A1 * 8/2014 Plude ..... H01B 5/12 335/6
2015/0055268 A1 * 2/2015 Chapel ..... H01H 47/02 361/160
2015/0055270 A1 2/2015 Chapel et al.
2017/0103865 A1 * 4/2017 Ji ..... H01H 33/28
2017/0117747 A1 * 4/2017 Zhou ..... H01H 3/28

FOREIGN PATENT DOCUMENTS

CN 101901702 12/2010
CN 102034619 4/2011

* cited by examiner

PERMANENT MAGNET OPERATING MECHANISM FOR USE IN AUTOMATIC TRANSFER SWITCH

FIELD

The present application relates to an automatic transfer switch (ATS) operating device comprising a permanent magnetic actuator.

BACKGROUND

An ATS for consumer applications may be used, for example, to selectively couple a local load from a residential or commercial building to a utility power grid. ATS devices may also be used to selectively couple a local load to a generator when a power outage has occurred. A typical ATS has two power source inputs and an output. A typical ATS is composed of multiple parts such as an actuator, solenoids and contactors. Most ATS devices utilize solenoid or motor operating mechanisms for opening and closing operations, and require exclusive locking and tripping devices to maintain opening and closing states. ATS designs have complicated constructions and numerous parts, particularly with respect to subsystems for actuation.

SUMMARY

An embodiment of the present disclosure relates to an ATS system including a contact subsystem having a plurality of movable contact members, including at least one first movable contact member at a first location and at least one second movable contact member at a second location, and at least one fixed contact member at one location. The ATS system further includes a permanent magnet operating mechanism structured to control opening and closing of the plurality of movable contact members relative to the at least one fixed contact member, generate a holding force so as to maintain a state of the at least one first movable contact member at the first location and a state of the at least one second movable contact member at the second location, and connect to the subsystem via a linkage. The ATS system additionally includes a solenoid permitting movement of one of the at least one first movable contact member at the first location and the at least one second movable contact member at the second location.

Another embodiment relates to a transmission subsystem having an open transition ATS. The ATS comprises a pair of movable contact members including a first movable contact member at a first location and a second movable contact member at a second location, a fixed contact member, a solenoid permitting selection of one of the first and second movable contact members, and a permanent magnetic actuator. The actuator comprises an actuator body, a first driving rod, and a second driving rod. The actuator is structured to move the first driving rod in a first direction independently of movement of the second driving rod, to move the first driving rod to drive the pair of movable contact members, and to move the second driving rod to select a power source.

A further embodiment relates to a method of actuating an ATS in a system. The ATS includes a plurality of movable contact members including a first set of movable contact members fixed on and rotatable with a first shaft, and a second set of movable contact members fixed on and rotatable with a second shaft. The ATS further includes an actuator that controls opening and closing of the movable contact members, a solenoid that moves the movable contact members, at least one fixed contact member, and first and second driving rods respectively fixed with the first and second shafts. The method comprises controlling opening and closing of the plurality of movable contact members relative to the at least one fixed contact member, and generating a holding force so as to maintain a state of the first set of movable contact members and a state of the second set of movable contact members. The method further includes opening the first shaft when the second shaft is closed, and opening the second shaft when the first shaft is closed.

Various embodiments of the systems, apparatuses and methods described herein may result in improved reliability and an extended lifetime by achieving a more robust design. Additionally, in various embodiments, the overall complexity and precision required in manufacturing may be reduced. Assembly time may also be reduced.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

DETAILED DESCRIPTION

Figure 1:
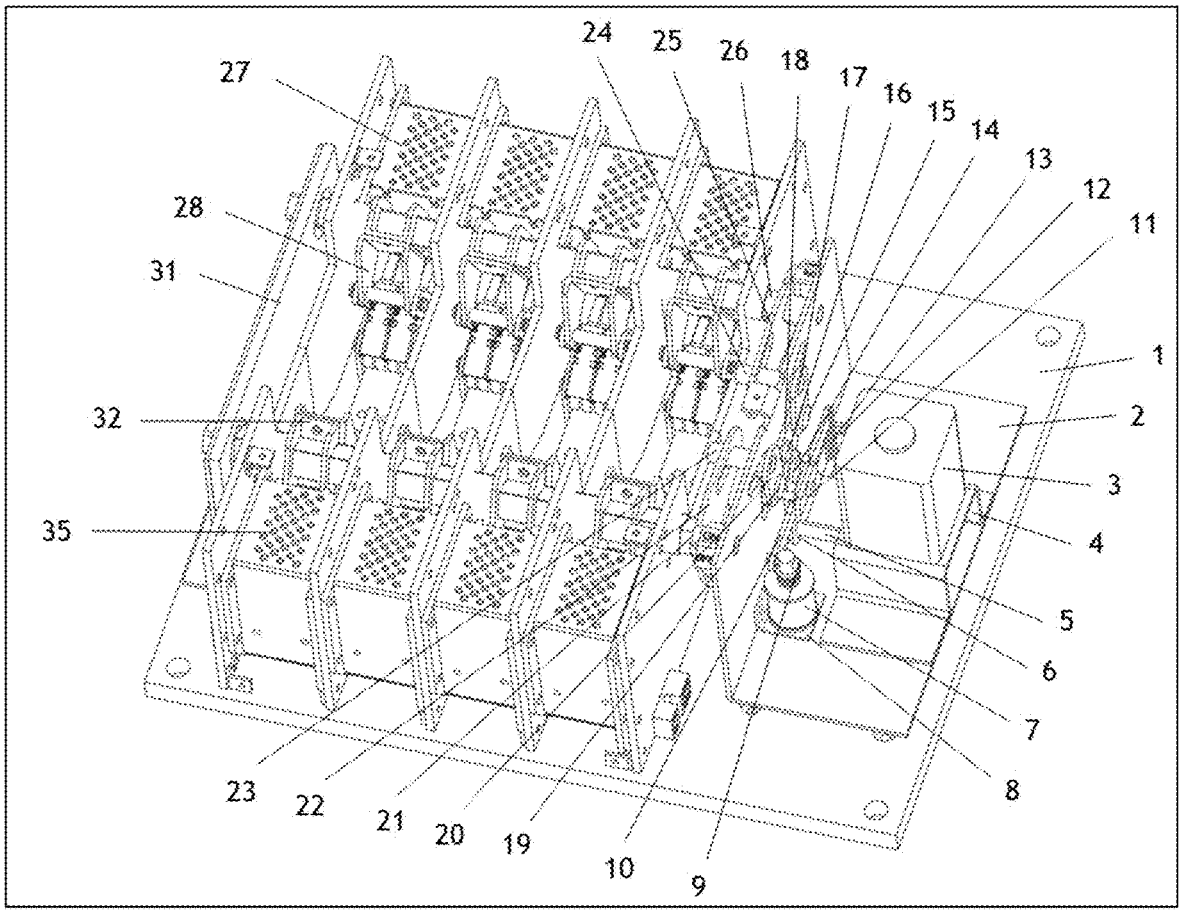
FIG. 1 illustrates a perspective view of an ATS system, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

As noted above, ATS devices typically are made of complex structures that may have less robust designs and which necessitate obtaining and integrating numerous parts. These devices suffer from reliability problems that ultimately may shorten their life cycles, and their need for high numbers of components and precision manufacturing make it difficult to control their consistency. Accordingly, more robust and simplified switches may alleviate the manufacturing and reliability challenges associated with these devices, while enhancing their product life cycles.

Some ATS devices may include permanent magnetic actuators. ATS devices with such actuators are described in PCT Patent Application Nos. PCT/CN2014/071857, entitled "Automatic Transfer Switch" and filed on Jan. 30, 2014, and PCT/CN2014/079590 entitled "Automatic Transfer Switch," filed on Jun. 10, 2014, which are herein incorporated by reference in their entirety for the technical and background information described therein.

The embodiments discussed below advantageously achieve high reliability and long life cycles, while reducing the need for maintenance. Such embodiments offer distinct reliability and performance enhancements in comparison with typical ATS devices. In particular, typical ATS devices strictly confine the distance between transmission square shafts of two sources due to their operating mechanism structures. This constained distance may impair the driving force, making it more difficult to achieve a good contact force, especially for high current ATS devices. Further, whereas some permanent magnetic devices have separate operations for two source contactors and may misoperate, the embodiments herein have a reduced misoperation risk and may require less troubleshooting.

Referring to the figures generally, the various embodiments disclosed herein relate to an ATS system having a permanent magnetic actuator. The permanent magnetic actuator operates transmission components to open or close movable contact subsystems (also referred to as contact members) onto fixed contact subsystems. A switch is used to select a first movable contact subsystem ("source A") or a second movable contact subsystem ("source B"). The operation of the transmission components by the permanent magnetic actuator moves the selected movable contact subsystem into an open or closed position. The movable contact subsystems are held in place using the force generated from the permanent magnetic actuator without relying on traditional mechanical locking and tripping devices.

FIG. 1 depicts an embodiment of an ATS system 100, shown from a perspective view. As shown in FIG. 1, the ATS 100 has a baseplate 1 including at least two pole contact systems 28, 32. The pole contact systems 28, 32 contain two sources for movable contact subsystems 30, 34. The ATS 100 further includes permanent fixed contact systems 29, 33 and arc chute systems 27, 35. The chute systems 27, 35 extinguish the arc.

Referring again to FIG. 1, the ATS 100 includes stabilizing members such as brackets 2, 31, which provide support for components on the baseplate 1. As shown in FIG. 1, the brackets 2, 31 may be disposed in different orientations from each other and may be configured differently. As depicted in FIG. 1, the bracket 2 includes a substantially horizontal portion parallel to the baseplate 1, and a substantially vertical portion projecting from and perpendicular to the baseplate 1. The brackets 2, 31 are configured to contact additional components of the ATS 100 as discussed in more detail below.

Referring yet again to FIG. 1, the ATS 100 further includes square shafts 21, 26 that are connected between the brackets 2, 31 through holes in the brackets 2, 31. The shafts 21, 26 are a linkage connecting an actuator, discussed below, to the movable contact systems 30, 34. The movable contact subsystem 30 is fixed on and rotates so as to follow the square shaft 26. The movable contact system 34 is fixed on and rotates following the square shaft 21. Furthermore, the square shaft 21 is additionally fixed with and rotates to follow an oscillating rod 22. The square shaft 26 is additionally fixed with and rotates to follow an oscillating rod 25. The oscillating rods 22, 25 allow for extension of the distance between the square shaft 21 and the square shaft 26, thereby improving force transmission conditions.

The ATS system 100 shown in FIG. 1 is an open-transition ATS that applies a permanent magnetic actuator 3 to cause the movable contact subsystems 30,34 to close onto or open from the fixed contact subsystems 29, 33 through a transmission assembly described below. The ATS system 100 further includes a solenoid 7 and an extension structure to select the source A movable contact subsystems 34 or the source B movable contact subsystems 30 to be moved. In this manner, the ATS system 100 obviates the need for traditional mechanical locking and tripping devices. In particular, the ATS system 100 advantageously uses a permanent magnetic holding force generating from the permanent magnetic actuator 3 to maintain the state of movable contact subsystems 30, 34.

Figure 2:
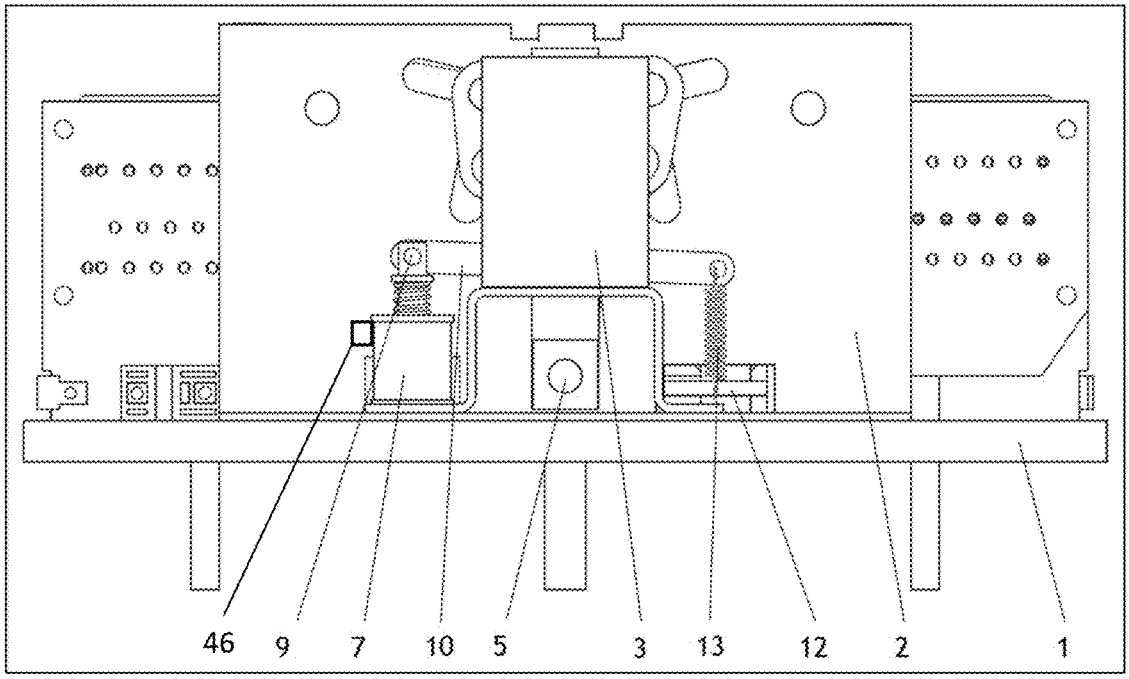
FIG. 2 is a left side view of the ATS system shown in FIG. 1 in a neutral position.
Figure 3:
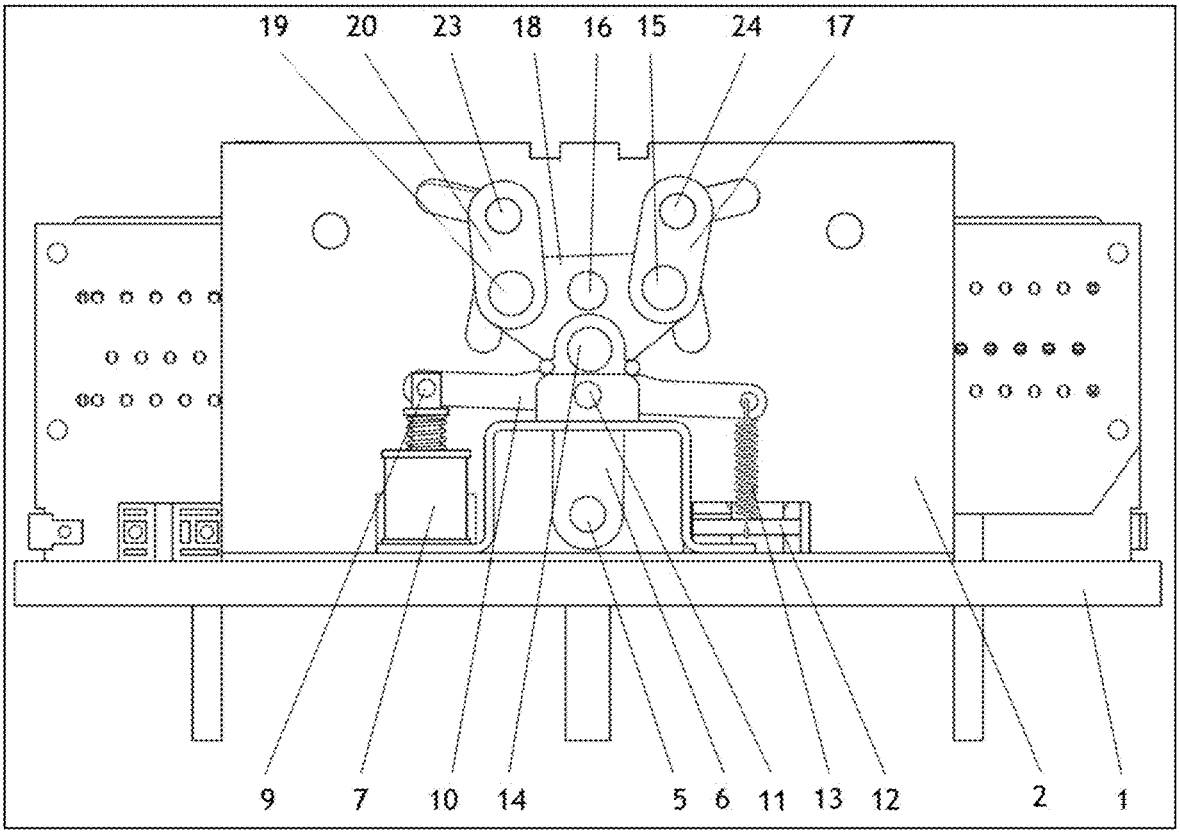
FIG. 3 depicts a left side view of the ATS system shown in FIG. 2, in which a permanent magnetic actuator is removed.
Figure 4:
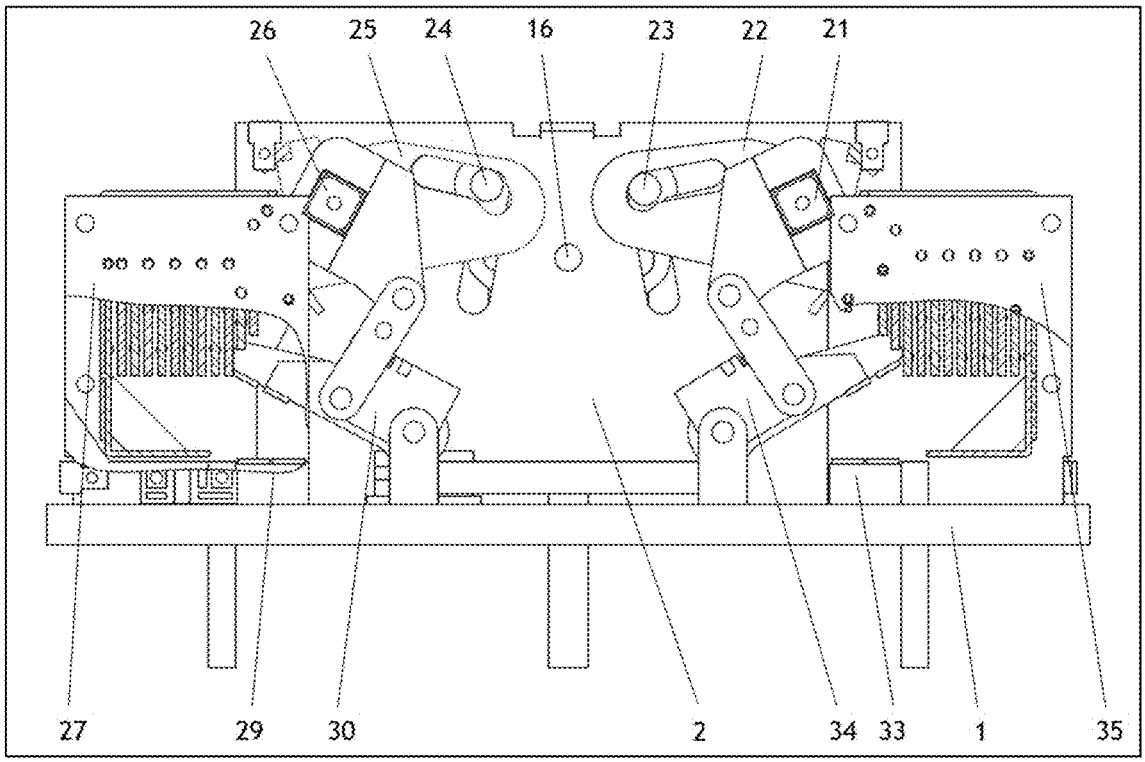
FIG. 4 depicts a right side view of the ATS system shown in FIG. 1, in which a bracket is removed.

Referring to FIGS. 2 and 3, the bracket 2 is provided with a plurality of slots or holes, which may have different orientations, dimensions and locations. As shown in FIG. 4, pins 23, 24 are provided so as to connect the oscillating rods 22, 25 to the bracket 2 via slots in the bracket 2. Specifically, the pins 23, 24 connect to the oscillating rods 22, 25 via slots in the oscillating rods 22, 25 and the slots in the bracket 2. The pin 23 moves along slots in the oscillating rod 22, while the pin 34 moves along slots in the oscillating rod 25.

Referring again to FIGS. 2 and 3, the slots in the bracket 2 may have a variety of shapes. For example, in at least one embodiment, slots in the bracket 2 may have a shape akin to the number '7,' where the slot shape is defined by a counterpoint (i.e., is contrapuntal) or an inflection point. In some configurations, the slot may be polygonal or serpentine, and may include rectilinear and/or curvilinear elements, for example. Further, various components may also be connected to the bracket 2, either directly or indirectly. As illustrated in FIG. 1, for example, a bracket 4 is attached to the bracket 2.

Figure 6:
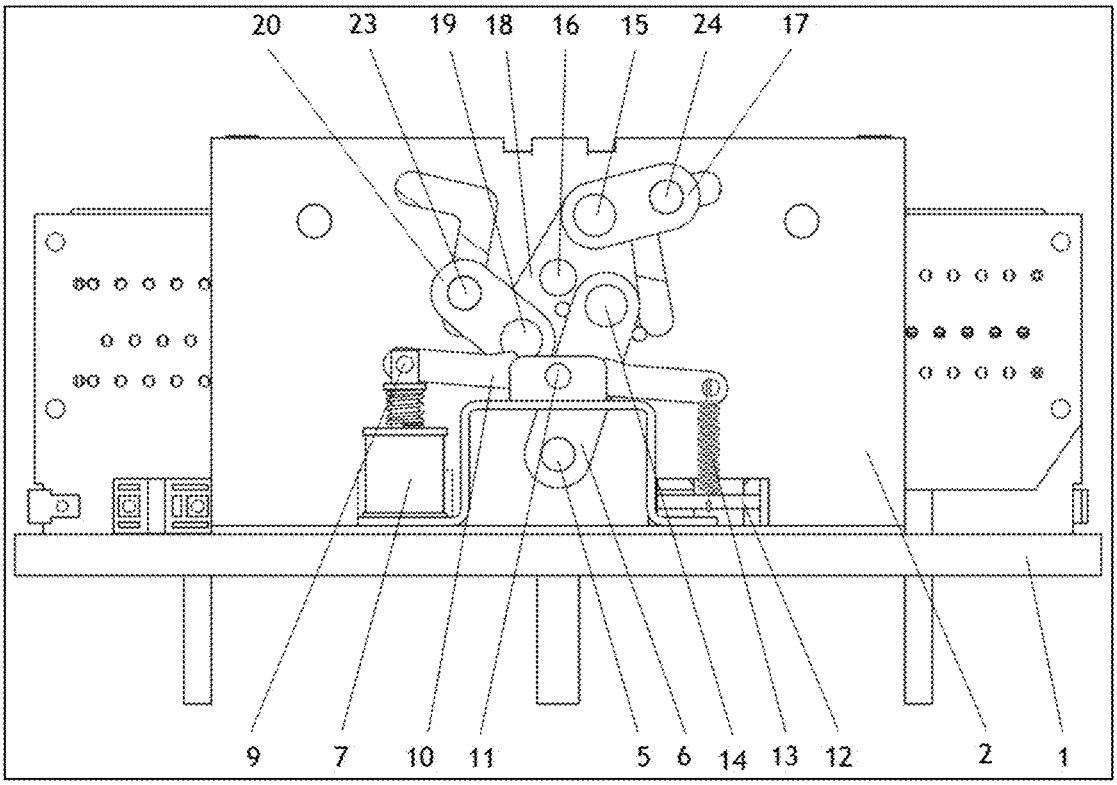
FIG. 6 depicts a left side view of the ATS system of FIG. 5, in which a permanent magnetic actuator is removed.

As shown in FIGS. 1 and 2, a permanent magnetic actuator 3 is fixed on the bracket 4 and has an axis perpendicular to the baseplate 1. Furthermore, the bracket 4 is fixed on the bracket 2. One end of permanent magnetic actuator 3 connects with a link rod 6 by a shaft 5, as shown in FIG. 3. The link rod 6 connects to an oscillating plate 18 via a pin 14. The oscillating plate 18 is connected to the bracket 2 by a pin 16, as shown in FIG. 3. Additionally, a link rod 17 is connected with the oscillating plate 18 by a pin 15, shown in FIG. 3, for example. Further, a link rod 20 is connected with the oscillating plate 18 by a pin 19, as illustrated in FIGS. 3 and 6. The pins 15, 19 are installed through holes that may align with a hole for installing the pin 16 in the oscillating plate 18 in the horizontal direction. Pins 23 are fixed on link rods 20, and pins 24 are fixed on link rods 17, shown in FIGS. 4, 6 and 7, for example.

Figure 5:
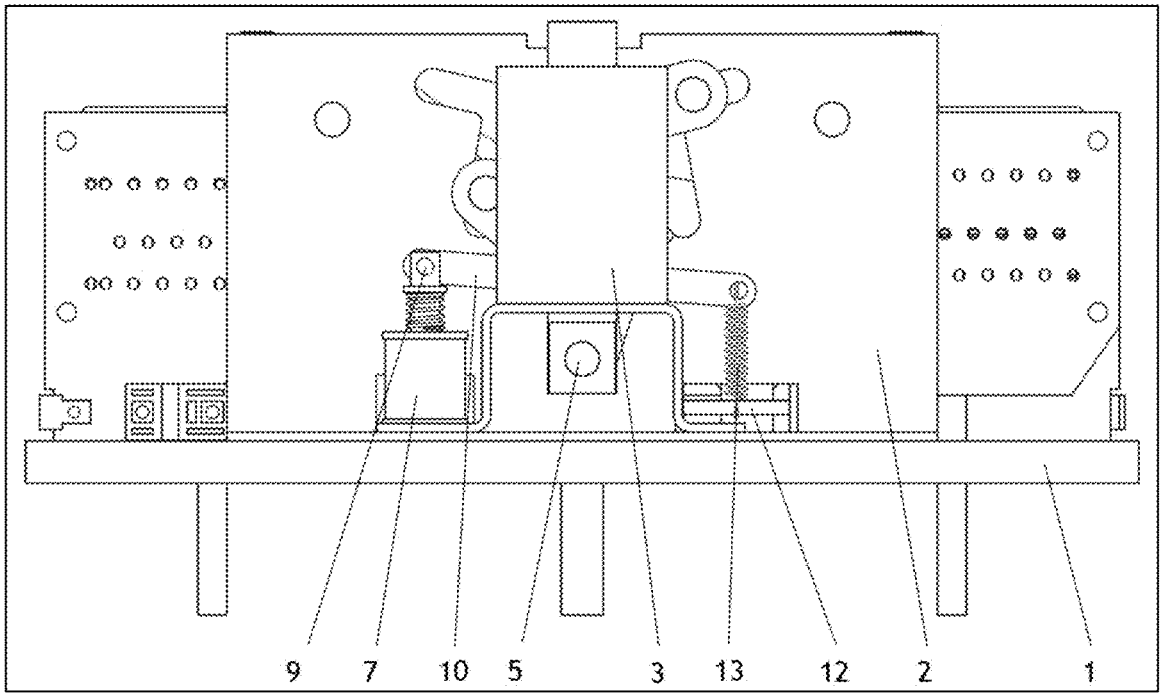
FIG. 5 depicts a left side view of the ATS system of FIG. 1 with the first movable contact subsystem in a closed position.

Referring now to FIG. 5, the ATS further includes a solenoid 7 on one side. The solenoid 7 is fixed on the bracket 8, with its vertical axis perpendicular to the baseplate 1. The bracket 8 is fixed on the bracket 2. Further, one end of the solenoid 7 connects with the link rod 10 by the pin 9 through a slot in one end of the link rod 10 and a hole in solenoid 7, as shown in FIG. 6, for example. The link rod 10 is connected to the bracket 4 by pin 11 and touches convex blocks in the link rod 6. An extension spring 13 connects the other end of link rod 10, as shown in FIG. 6. The link rod 10 rotates to a predetermined angle in a clockwise direction along a pin 11 under the action of the extension spring 13 when in a free state, thus causing the link rod 6 to rotate to a predetermined angle in a clockwise direction along the shaft 5. Further, a shaft 12 is fixed on bracket 2 and coupled to the extension spring 13.

The ATS system 100 is structured to operate such that when the oscillating rod 22 rotates in the clockwise direction and the oscillating rod 25 rotates in the counterclockwise direction, the opening and closing of the movable contact subsystems 30, 34 are controlled. Specifically, the movable contact subsystems 34 close when the oscillating rod 22 rotates in the counterclockwise direction. Conversely, when the oscillating rod 25 rotates in the clockwise direction, the oscillating rod 25 causes the movable contact subsystems 30 to close.

In at least one embodiment, the actuator has a first state in which the permanent magnet operating mechanism is configured to retain the actuator unless a coil is powered to retain the actuator in a second state. In at least one embodiment, the actuator has a first magnetically stable retained state and second magnetically stable retained state, and the actuator is configured to transition between the first and the second states when at least one coil of the actuator receives power. The actuator of certain embodiments is connected at first and second ends of the actuator, and is configured to move the automatic transfer switch between a first state, a second state, and a third state. In at least one embodiment, the first state corresponds to a first source, the second state corresponds to a neutral, and the third state corresponds to a second source.

As described in further detail below, the ATS system 100 has at least a neutral state, a state in which the source A movable contact subsystem 34 is closed, and a state in which the source B movable contact subsystem 30 is closed. For example, FIG. 2 depicts the ATS system 100 in a neutral position. In the neutral position, the permanent magnetic actuator 3 utilizes a permanent magnetic holding force to pull the link rod 6 through shaft 5 downward to drive the oscillating plate 18 rotating at a certain angle so that the oscillating plate 18 attains an interim position (which may also be referred to herein as a middle, intermediate or medium position).

Figure 8:
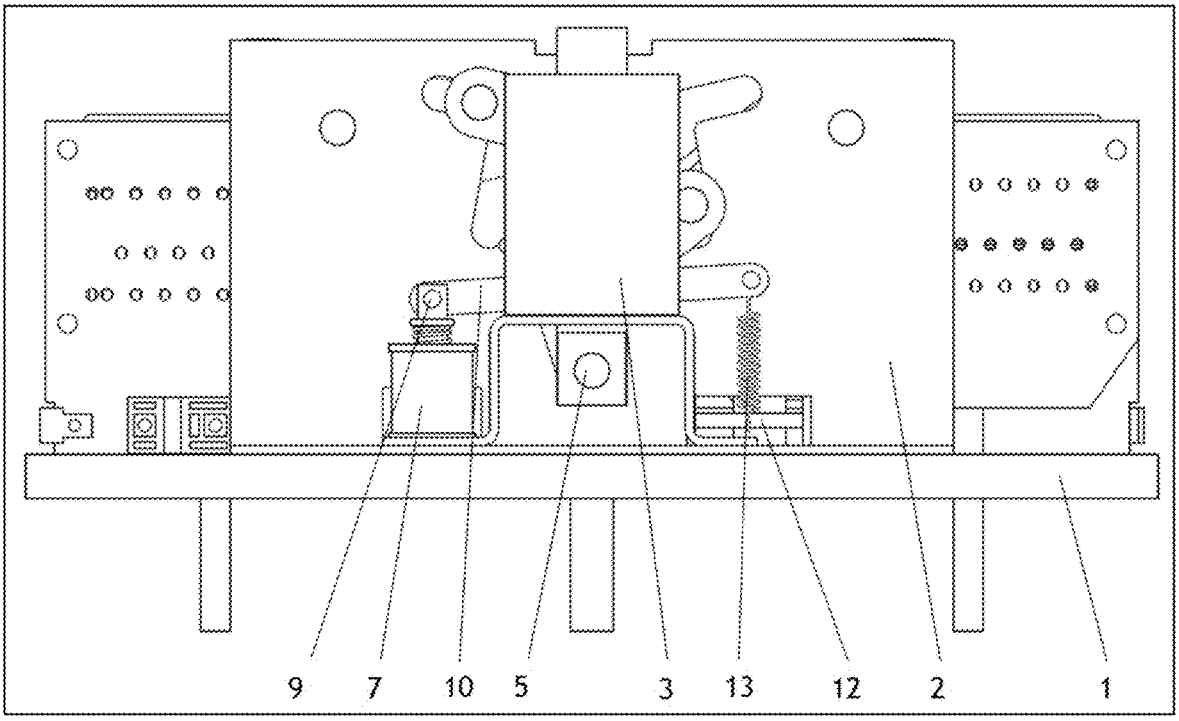
FIG. 8 depicts a left side view of the ATS system of FIG. 1, with the second movable contact subsystem in a closed position.

In particular, the ATS system 100 is structured so that various components are controlled via a permanent magnetic holding force. In particular, a permanent magnetic holding force acts to maintain the position of the oscillating plate 18. The permanent magnetic holding force also acts so that the link rods 17, 20 remain in a corner of their slots in the bracket 2, and so that the oscillating rods 22, 25 stay at the maximum rotating angle which makes the movable contact subsystems 30, 34 open from the fixed contact subsystems 29, 33 to a maximum defined angle. The solenoid 7 keeps still in this process, while the link rod 10 rotates at a defined angle by the force of extension spring 13 in a clockwise direction along the pin 11, where the solenoid 7 and the extension spring 13 are disposed on opposite sides of the actuator 3, as shown in FIG. 8. In this manner, the link rod 6 also rotates at a defined angle in the clockwise direction along shaft 5, so as to facilitate the closing operating of the source A movable contact subsystem 34.

Referring now to FIG. 6, a state of the ATS system 100 in which the source A movable contact subsystem 34 is closed is depicted. The source A movable contact subsystem 34 is closed from the neutral position, thus moving the source A movable contact subsystem 34 from a first location to a second location. To attain this closed state, the permanent magnetic actuator 3 utilizes the permanent magnetic holding force pushing the link rod 6 through the shaft 5 upward to drive the oscillating plate 18, rotating at a defined angle, in a counterclockwise direction along the pin 16. This pushing of the link rod 6 acts to move the oscillating plate 18 to a limit position and to maintain such a position.

Figure 7:
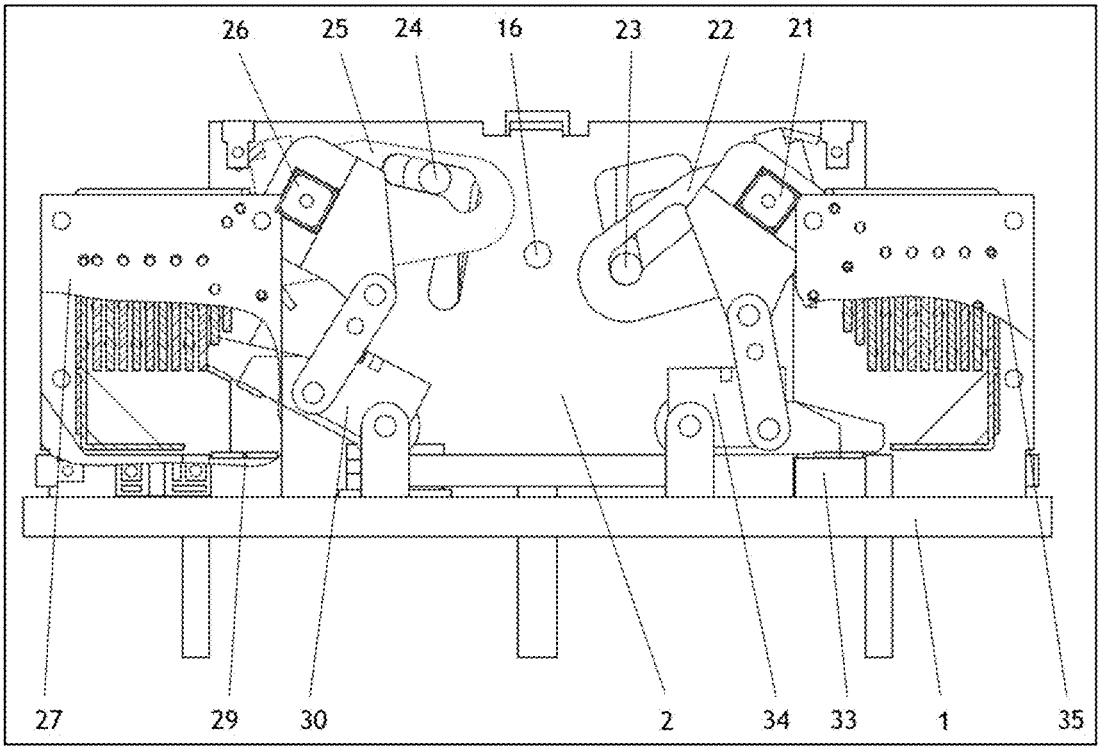
FIG. 7 depicts a right side view of the ATS system of FIG. 5, in which a bracket is removed.

Further, the force acts so that the link rod 20 is pulled down through the slot in the bracket 2 to a defined position and maintained at the position by the oscillating plate 18 through the pin 19. In this manner, the oscillating rod 22 is rotated a defined angle along the axis of square shaft 21 in the counterclockwise direction to a defined position by the link rod 20, via the pin 23, illustrated in FIG. 9. In particular, the pin 23 makes the square shaft 21 rotate at the same angle and causes the closing of the source A movable contact subsystem 34 on the fixed contact subsystem 33, as shown in FIG. 7. Moreover, the link rod 17 is pushed upward along the slot in the bracket 2 and a slot in oscillating rod 25 (which may also be shaped as a 'contrapuntal' slot formed like the number '7,' among other variations), and the oscillating rod 25 is structured to remain in place (remaining still), leading the source B movable contact subsystem 30 to continue opening. The solenoid 7 also keeps still in this process, while the link rod 10 rotates at the same defined angle as in the neutral position by the force of the extension spring 13 in the clockwise direction along the pin 11. In this case, the link rod 10 no longer touches the link rod 6.

FIG. 8 depicts a state of the ATS system 100 in which the source B movable contact subsystem 30 is closed. Specifically, the source B movable contact subsystem 30 is closed from neutral position, thus moving the source B movable contact subsystem 30 from a first location to a second location. In this state, the solenoid 7 is energized first and utilizes electromagnetic force to pull the link rod 10 through the pin 9 downward to rotate the link rod 10 along the pin 11 to the defined limit position in a counterclockwise direction. The force of the solenoid 7 makes the link rod 6 rotate to a defined angle in the counterclockwise direction along the shaft 5.

Figure 9:
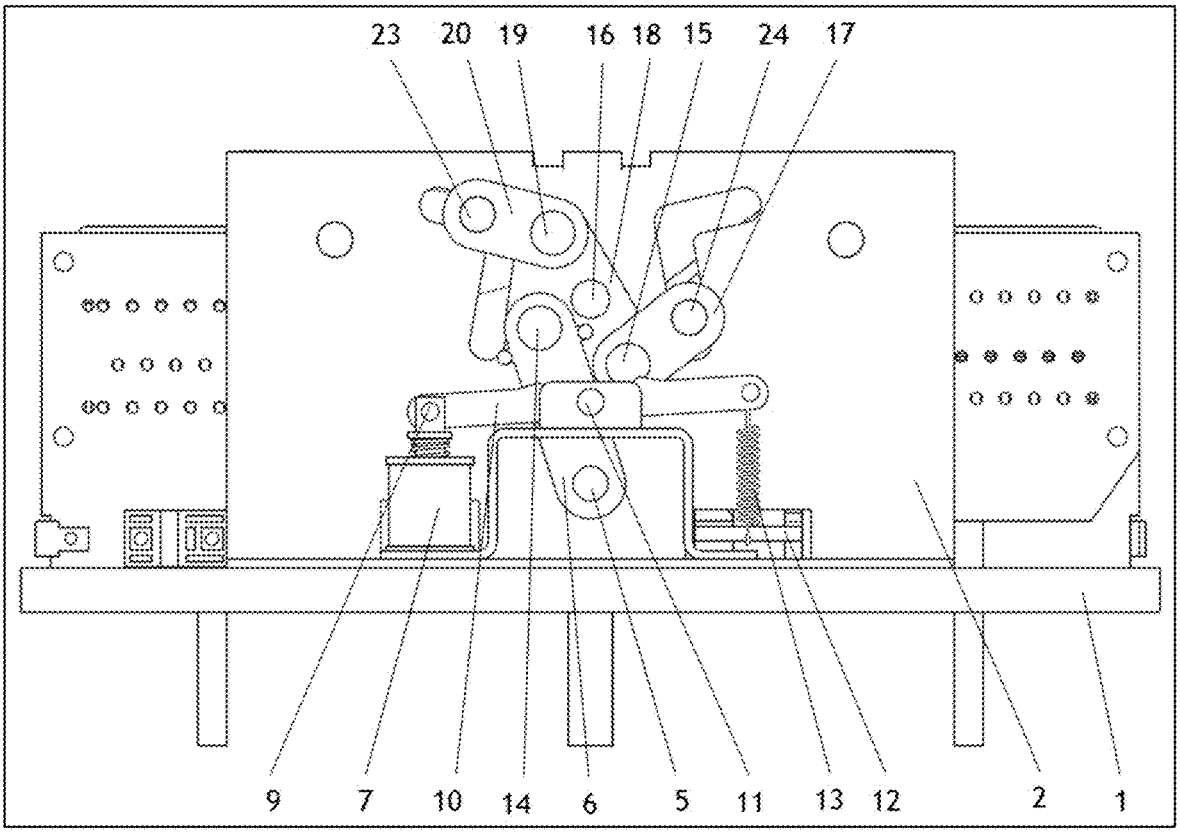
FIG. 9 is a left side view of the ATS system of FIG. 8, in which a permanent magnetic actuator is removed.
Figure 10:
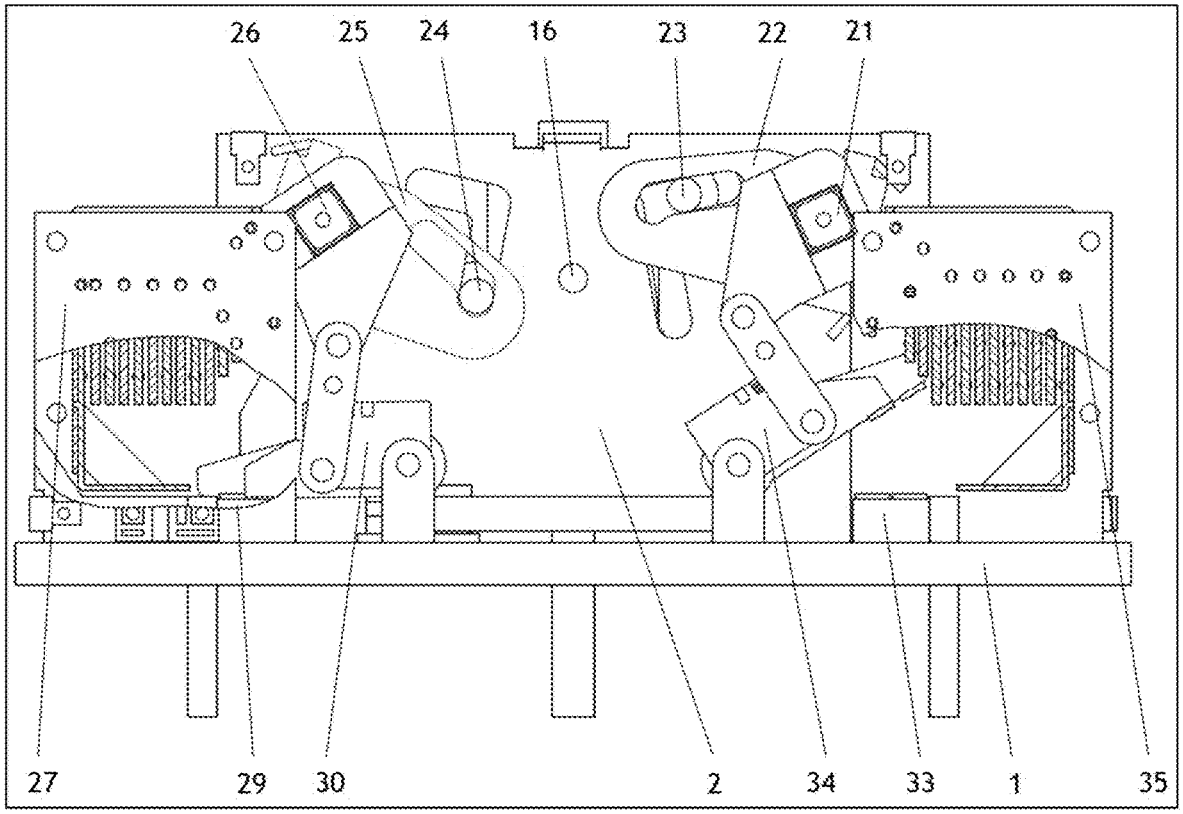
FIG. 10 depicts the right side view of the ATS system of FIG. 8, in which a bracket is removed.

Further, the permanent magnetic actuator 3 may utilize its permanent magnetic holding force to push the link rod 6 upward through the shaft 5. By virtue of the link rod 6 being pushed upward through the shaft 5, the link rod 6 serves to drive the oscillating plate 18. The oscillating plate 18, as shown in FIG. 9, for example, rotates to a defined angle in the clockwise direction along the pin 16 to a limit position. Upon being driven by the link rod 6, the oscillating plate 18 is configured to maintain the limit position.

Additionally, the link rod 17 shown in FIG. 9 is pulled down along a slot in the bracket 2 to a defined position and maintained in this position by the oscillating plate 18 via the pin 15. Further, the oscillating rod 25 may be rotated to a defined angle along the axis of the square shaft 26 in the clockwise direction to a defined position by the link rod 17 through the pin 24, which makes the square shaft 26 rotate to the same angle and closes the source B movable contact subsystem 30 onto the fixed contact subsystem 29. At substantially the same time, the link rod 20 is pushed upward along its slot in the bracket 2 and along the corresponding slot in the oscillating rod 22. The oscillating rod 22 remains in place, keeping still, thus causing the source A movable contact subsystem 34 to continue opening.

As noted above, after the operation of permanent magnetic actuator 3, the link rod 10 no longer touches the link rod 6, and the solenoid 7 no longer provides power to the link rod 10. Accordingly, the link rod 10 rotates back to the same position as before it was powered by the solenoid 7 in the clockwise direction by the force of the extension spring 13 along the pin 11, without touching the link rod 6. The ATS system 100 is applied herein in the open transition mode. Accordingly, when the source A movable contact subsystem 34 is closing and it is time to close the source B movable contact subsystem 30, the source A movable contact subsystem 34 should first be opened to the neutral position described above, and then perform the process of closing the source B movable contact subsystem 30 from the neutral position, and vice versa.

Numerous variations and substitutions are expressly contemplated with respect to the above-described embodiments. For example, the actuator 3 may be a dual-end, dual-slug actuator or a single-slug piston actuator. Further, the actuator 3 in certain embodiments may be bi-stable, with permanent magnetic holding states at each first and second end of a throw of the actuator 3. Alternatively, the actuator 3 may be monostable, with only a single permanent magnetic holding state at a first end of the actuator's throw, and the other state or second throw end held only when activated. Additionally, while the movable contact subsystems 30, 34 may be moved as described above, they are also configured to be moved manually.

By way of further example, the solenoid 7 may be controlled by a control module 46 shown in FIG. 2 in at least one embodiment. The control module 46 controls the solenoid 7 to select one of the first and second movable contact subsystems 30, 34 and to move them in the manner described above. Although the embodiment in FIG. 2 depicts the control module 46 being together with the solenoid 7, alternative embodiments may provide the control module 46 at a remote location from the solenoid 7. Furthermore, the control module 46 may comprise non-transitory computer readable media, as described in more detail below.

Figure 11:
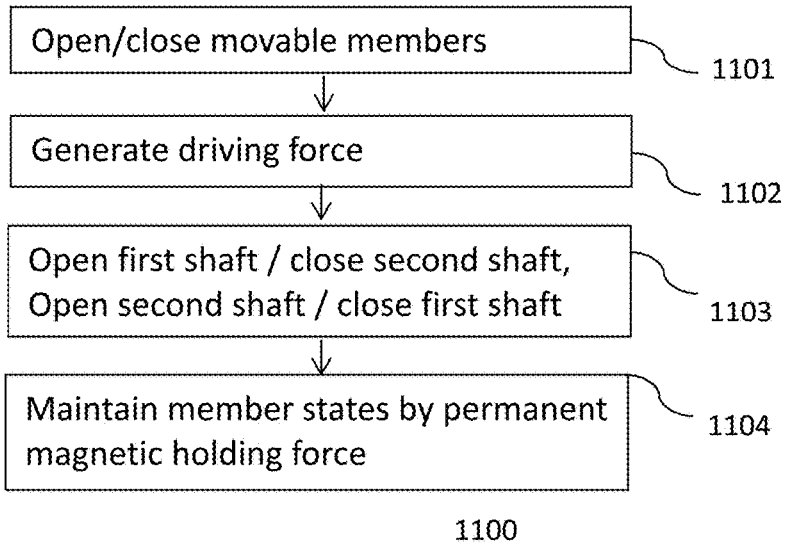
FIG. 11 depicts a method of carrying out automatic transfer switching according to an embodiment.

Turning now to FIG. 11, a method of carrying out automatic transfer switching according to an embodiment is shown. Specifically, a method 1100 is described for carrying out automatic transfer switching for an ATS system (such as the ATS system 100) which includes a plurality of movable members including a first set of movable contact members fixed on and rotatable with a first shaft, and a second set of movable members fixed on and rotatable with a second shaft. The switch further includes at least one fixed contact member, and first and second rods respectively fixed with the first and second square shafts.

The method 1100 includes performing switching via an actuator such as the actuator 3 described above. More particularly, the method includes controlling opening and closing of the plurality of movable members relative to the at least one fixed member (1101). Additionally, the method includes generating a magnetic driving force with one or more permanent magnet actuators (1102). The method additionally involves opening a first shaft when a second shaft is closed, and opening the second shaft when the first shaft is closed (1103). The method further includes maintaining a state of the first set of movable members and a state of the second set of movable members (1104) under a permanent magnetic holding force.

The permanent magnetic operating mechanisms of the various embodiments described above may be implemented in a wide variety of ATS devices. For example, according to various embodiments, the permanent magnetic operating mechanisms can be applied to an ATS that complies with at least one of applicable IEC standards and applicable UL standards. Further, such embodiments advantageously improve operating performance and reduce warranty expenses, as described above.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "right," "left," etc.) are merely used to describe the orientation of various elements in the accompanying drawings. It should be noted that the orientation of various elements may differ according to other example embodiments, and that such variations are intended to be encompassed by the present disclosure.

Certain functional details described in this specification are described as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in machine-readable media for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Where a module is implemented, or portions of a module are implemented, in a machine-readable medium or media (or a computer-readable medium or media), the computer readable program code may be stored and/or propagated on in one or more computer readable media.

The computer readable medium or media may be a tangible computer readable storage medium or media storing the computer readable program code. The computer readable storage medium or media may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium or media may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium or media may also be a computer readable signal medium or media. The computer readable signal medium or media may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing.

The computer readable medium or media may comprise a combination of one or more computer readable storage media and one or more computer readable signal media. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on a user's computer, partly on the user's computer, as a stand-alone computer-readable package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The program code may also be stored in a computer readable medium that can direct a computer, other programmable data processing apparatus, or other devices to function in a particular manner, such that the instructions stored in the computer readable medium produce an article of manufacture including instructions which implement the function/act specified in schematic flowchart diagrams and/or schematic block diagrams block or blocks.

The construction and arrangement of the aforementioned various example embodiments are illustrative only. Although only a few embodiments are described in detail in this disclosure, those skilled in the art will readily appreciate that, unless specifically noted, many modifications are possible (e.g., variations in sizes, structures, shapes and proportions of the various elements, values of parameters, mounting arrangements, use of materials, orientations, etc.) without materially departing from the teachings and advantages of the subject matter described herein. For example, elements shown as integrally formed may be constructed of multiple parts or elements, the position of elements may be reversed or otherwise varied, and the nature or number of discrete elements or positions may be altered or varied. Unless specifically noted, the order or sequence of any process or method steps may be varied or re-sequenced according to alternative embodiments.

The foregoing description of illustrative embodiments is not intended to be exhaustive or limiting with respect to the precise form disclosed, and modifications and variations, such as those discussed above, are possible in light of the above teachings or may be acquired from practice of the disclosed embodiments. Other substitutions, modifications, changes and omissions may also be made in the design, operating conditions and arrangement of the various example embodiments without departing from the scope of the present invention.

The invention claimed is:

1. An automatic transfer switch system, comprising:

a contact subsystem comprising:

a plurality of movable contact members including at least one first movable contact member at a first location and at least one second movable contact member at a second location; and at least one fixed contact member;

a permanent magnet operating mechanism connected to the contact subsystem via a linkage, the permanent magnetic operating mechanism controlling opening and closing of the plurality of movable contact members relative to the at least one fixed contact member, and maintaining a state of the at least one first movable contact member at the first location and a state of the at least one second movable contact member at the second location by a permanent magnetic holding force; and a solenoid permitting movement of one of the at least one first movable contact member at the first location and the at least one second movable contact member at the second location, wherein the plurality of movable contact members are configured to be moved manually.

2. The automatic transfer switch system of claim 1, wherein the permanent magnet operating mechanism comprises an actuator having an actuator body, a first driving rod, and a second driving rod.

3. The automatic transfer switch system of claim 2, wherein:

each of the first driving rod and the second driving rod is movable to transmit a driving force from the body of the actuator;

the force of the permanent magnet operating mechanism moves the first and second driving rods in respective first and second directions independently of each other.

4. The automatic transfer switch system of claim 2, wherein a driving force of the first driving rod moves the at least one first movable contact member from the first location to another location, and a driving force of the second driving rod moves the at least one second movable contact member from the second location to another location.

5. The automatic transfer switch system of claim 2, further comprising a member disposed between the first driving rod and the second driving rod.

6. The automatic transfer switch system of claim 1, wherein:

the linkage comprises a first shaft and a second shaft rotatably supported by the permanent magnet operating mechanism and coupled to the first and second movable contact members, and the first and second shafts are driven by at least one of the driving rods.

7. The automatic transfer switch system of claim 6, wherein:

the first shaft and the second shaft are arranged to rotate in accordance with the opening and closing of the plurality of movable contact members, the first shaft opens when the second shaft closes, and the second shaft opens when the first shaft closes.

8. The automatic transfer switch system of claim 1, wherein the contact subsystem is formed of the plurality of movable contact members and at least two fixed contact members.

9. The automatic transfer switch system of claim 1, wherein the permanent magnet operating mechanism permits closing of at least one movable contact member onto at least one fixed contact member and opening of at least one movable contact member from at least one fixed contact member.

10. A transmission subsystem having an open transition automatic transfer switch, comprising:

a pair of movable contact members including a first movable contact member at a first location and a second movable contact member at a second location;

a fixed contact member;

a controller permitting selection of one of the first and second movable contact members; and a permanent magnetic actuator comprising an actuator body, a first driving rod, and a second driving rod, and effectuating movement of the first driving rod in a first direction independently of movement of the second driving rod;

wherein the first driving rod drives the pair of movable contact members, and wherein the power source is selectable by moving the second driving rod.

11. The transmission subsystem of claim 10, wherein the permanent magnetic actuator is a bistable permanent actuator.

12. The transmission subsystem of claim 10, wherein the permanent magnetic actuator is a monostable permanent actuator.

13. The transmission subsystem of claim 10, wherein the controller comprises an electromagnetic solenoid.

14. The transmission subsystem of claim 10, wherein a contact subsystem is formed of the pair of movable contact members and the fixed contact member.

15. The transmission subsystem of claim 10, wherein the pair of movable contact members are manually movable.

16. A method of actuating an automatic transfer switch in a system, the method comprising:

controlling, via an actuator, opening and closing of a plurality of movable contact members relative to at least one fixed contact member, the plurality of movable contact members including a first set of movable contact members rotatable with a first shaft, and a second set of movable contact members rotatable with a second shaft, controlling, via a solenoid, first and second driving rods respectively fixed with the first and second shafts to move the movable contact members, generating a driving force transmitted by the actuator, opening the first shaft when the second shaft is closed, and opening the second shaft when the first shaft is closed, and maintain a state of the first set of movable contact members and a state of the second set of movable contact members by a holding force, wherein the plurality of movable contact members are configured to be moved manually.

17. The method of claim 16, further comprising:

selecting one of the first and second sets of movable contact members as movable contact members to be opened and closed relative to the at least one fixed contact member.

18. The method of claim 16, further comprising:

transitioning at least one set of the movable contact members from an open position to a neutral position, and transitioning the at least one set of the movable contact members from the neutral position to a closed position.

19. The method of claim 16, further comprising:

transitioning between a first magnetically stable retained state of the actuator and a second magnetically stable retained state of the actuator when at least one coil of the actuator receives power.

* * * * *